US007543635B2

(12) United States Patent
East et al.

(10) Patent No.: US 7,543,635 B2
(45) Date of Patent: Jun. 9, 2009

(54) FRACTURE CHARACTERIZATION USING RESERVOIR MONITORING DEVICES

(75) Inventors: Loyd East, Tomball, TX (US); Mohamed Soliman, Cypress, TX (US); Dwight Fulton, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 234 days.

(21) Appl. No.: 10/987,147

(22) Filed: Nov. 12, 2004

(65) Prior Publication Data

US 2006/0102342 A1 May 18, 2006

(51) Int. Cl.
*E21B 49/00* (2006.01)
*E21B 47/00* (2006.01)

(52) U.S. Cl. ..... 166/250.17; 166/66; 166/179; 166/250.1

(58) Field of Classification Search ..... 166/250.01, 166/250.17, 66, 250.7, 250.1, 179
See application file for complete search history.

(56) References Cited

U.S. PATENT DOCUMENTS

| | | | | |
|---|---|---|---|---|
| 2,055,506 | A | 9/1936 | Schlumberger | |
| 3,459,264 | A | 8/1969 | Olson et al. | |
| 4,898,241 | A * | 2/1990 | Wittrisch | 166/250.17 |
| 5,176,207 | A | 1/1993 | Keller | |
| 5,355,952 | A * | 10/1994 | Meynier | 166/250.01 |
| 5,372,038 | A | 12/1994 | Nicoletis | |
| 5,934,373 | A | 8/1999 | Warpinski et al. | |
| 6,904,797 | B2 * | 6/2005 | Schrenkel et al. | 73/152.18 |
| 6,935,424 | B2 * | 8/2005 | Lehman et al. | 166/250.1 |
| 2001/0023614 | A1 | 9/2001 | Tubel et al. | |
| 2003/0205375 | A1 | 11/2003 | Wright et al. | |
| 2005/0263281 | A1 * | 12/2005 | Lovell et al. | 166/255.1 |
| 2005/0274510 | A1 * | 12/2005 | Nguyen et al. | 166/250.12 |

FOREIGN PATENT DOCUMENTS

| | | |
|---|---|---|
| EP | 1 403 465 A1 | 3/2004 |
| WO | WO 01/04460 | 1/2001 |

OTHER PUBLICATIONS

Foreign Communication from related counter part application dated Nov. 7, 2005.

(Continued)

*Primary Examiner*—Jennifer H Gay
*Assistant Examiner*—Brad Harcourt
(74) *Attorney, Agent, or Firm*—Fonley Rose, P.C.

(57) ABSTRACT

A system for monitoring a wellbore service treatment, comprising a downhole tool operable to perform the wellbore service treatment; a conveyance connected to the downhole tool for moving the downhole tool in the wellbore, and a plurality of sensors operable to provide one or more wellbore indications and attached to the downhole tool or a component thereof via one or more tethers. A method of monitoring a wellbore service treatment, comprising conveying into a wellbore a downhole tool operable to perform the wellbore service treatment and a plurality of sensors operable to provide one or more wellbore indications attached to the downhole tool or a component thereof via one or more tethers, deploying the downhole tool at a first position in the wellbore for service, treating the wellbore at the first position; and monitoring an at least one wellbore indication provided by the wellbore sensors at the first position.

54 Claims, 8 Drawing Sheets

OTHER PUBLICATIONS

Wright, et al. ; *Real-time Fracture Mapping from the "Live" Treatment Well*; SPE 71648, pp. 1-7.
Stutz, et al.; *Calibrating Coal Bed Methane Fracture Geometry in the Helper Utah Field Using Treatment Well Tiltmeters*; SPE 77443; pp. 1-10.
Mayerhofer, et al.; *Optimizing Fracture Stimulation in a New Coalbed Methane Reservoir in Wyoming Using Treatment Well Tiltmeters and Integrated Fracture Modeling*; SPE 84490; pp. 1-10.
Halliburton Product Brochure; *FracTrac$^{SM}$ TW Fracturing Mapping Service*; 2001; 4 pages.
Halliburton Product Brochure; *CobraJet Frac$^{SM}$ Service*; 2 pages.
Halliburton Press Release; *Halliburton and Pinnacle Technologies Announce New Fractrac$^{SM}$ TW Service for Direct, Real-Time Measurement of Fracture Geometry*; Oct. 2, 2001; 3 pages.
Halliburton presentation; *Drawing of the FracTrac TW layout and blast joint design*; 2001; 1 page.

* cited by examiner 20
16
18a
18b
18c
18d
10
14
14
8
22
PUMP
24
26

FRACTURE CHARACTERIZATION USING RESERVOIR MONITORING DEVICES

BACKGROUND

The present disclosure is directed to wellbore lithology fractionation technology, more particularly to fracture characterization using reservoir monitoring devices, and more particularly, but not by way of limitation, to a system and method for using several sensors attached below a fracturing tool string.

A wide variety of downhole tools may be used within a wellbore in connection with producing hydrocarbons from a hydrocarbon formation. Downhole tools such as frac plugs, bridge plugs, and packers, for example, may be used to seal a component against casing along the wellbore wall or to isolate one pressure zone of the formation from another.

Fracturing is a wellbore service operation to break or fracture a production layer with the purpose of improving flow from that production layer. In the case that multiple zones of production are planned, fracturing may be conducted as a multi-step operation, for example positioning fracturing tools in the wellbore to fracture a first zone, pumping fracturing fluids into the first zone, repositioning the fracturing tools in the wellbore to fracture a second zone, pumping fracturing fluids into the second zone, and repeating for each of the multiple zones of production. Fracturing fluids sometimes propagate into water bearing formations, which is undesirable. Water must be separated at the surface from oil or gas and properly disposed of, imposing undesirable expenses on the production operation. If the production fluids are pumped to the surface, pumping energy, and hence money, is expended lifting the waste water product to the surface. What is needed is a system and method to detect during the course of a fracturing job when the fracturing fluid is propagating into a water bearing formation so that the fracturing job may be interrupted.

Fracturing tools may be withdrawn from the wellbore, and sensors may then be deployed into the wellbore and used to directly sense the results of fracturing. The sensors are withdrawn from the wellbore, the sensor information they have stored is downloaded to a computer, and the data is analyzed for use in planning future fracturing jobs in similar lithology structures or similar production fields. This two trip process is undesirable. What is needed is a system and method for co-deployment and co-retraction of fracturing tools and sensors for a fracturing service operation which may reduce the number of tool string trips into and out of the wellbore.

SUMMARY

Disclosed herein is a system for monitoring a wellbore service treatment, comprising a downhole tool operable to perform the wellbore service treatment; a conveyance connected to the downhole tool for moving the downhole tool in the wellbore, and a plurality of sensors operable to provide one or more wellbore indications and attached to the downhole tool or a component thereof via one or more tethers.

Further disclosed herein is a method of monitoring a wellbore service treatment, comprising conveying into a wellbore a downhole tool operable to perform the wellbore service treatment and a plurality of sensors operable to provide one or more wellbore indications attached to the downhole tool or a component thereof via one or more tethers, deploying the downhole tool at a first position in the wellbore for service, treating the wellbore at the first position; and monitoring an at least one wellbore indication provided by the wellbore sensors at the first position.

These and other features and advantages will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

It should be understood at the outset that although an exemplary implementation of one embodiment of the present disclosure is illustrated below, the present system may be implemented using any number of techniques, whether currently known or in existence. The present disclosure should in no way be limited to the exemplary implementations, drawings, and techniques illustrated below, including the exemplary design and implementation illustrated and described herein.

Figures 1A, 1B, 1C:
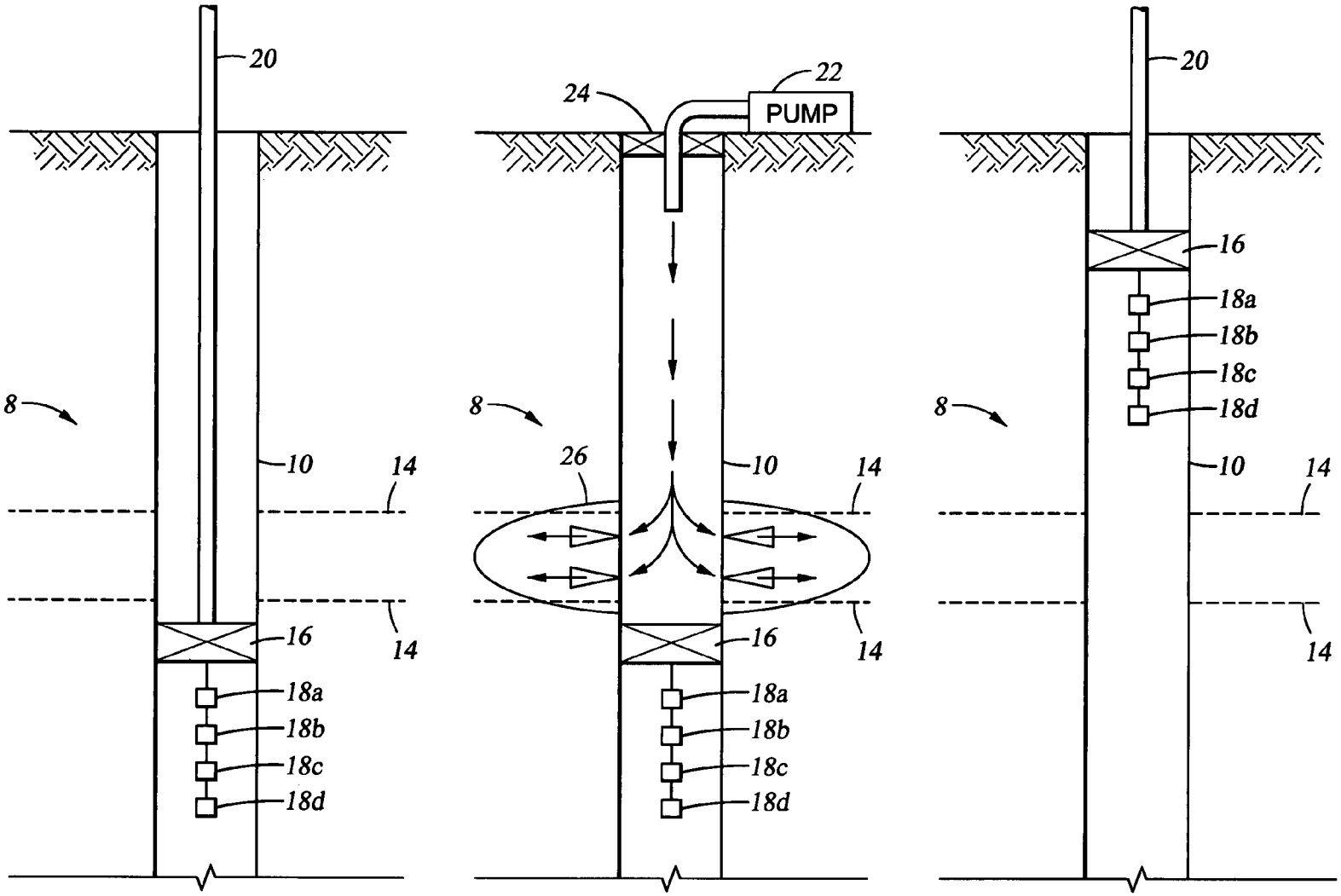
FIG. 1*a* depicts a wellbore and a first tool string in a first stage of a fracturing job.
FIG. 1*b* depicts a wellbore and a first tool string in a second stage of a fracturing job.
FIG. 1*c* depicts a wellbore and a first tool string in a third stage of a fracturing job.

FIGS. 1*a*, 1*b*, and 1*c* show a wellbore 10, which may be cased or uncased, and three stages of a wellbore service job corresponding to a first wellbore service configuration, in FIG. 1*a*, a second wellbore service configuration, in FIG. 1*b*, and a third wellbore service configuration, in FIG. 1*c*. The exemplary wellbore service job depicted is a fracturing service job, but the present disclosure contemplates other wellbore service jobs such as acidizing, gravel packing, cementing, perforating, logging, conducting a survey to collect data, placing downhole sensors, installing and shifting the position of gas lift valves and flow valves, and other wellbore service jobs known to those skilled in the art. The exemplary fracturing job is directed to improving the flow from a zone of interest 14. In an embodiment shown in FIGS. 1*a-c*, a first tool string 8 comprises a bridge plug 16 and a plurality of sensors 18—a first sensor 18*a*, a second sensor 18*b*, a third sensor 18*c*, and a fourth sensor 18*d*—attached to and hanging from the bridge plug 16. The sensors 18 may be referred to as a sensor array or an array of sensors.

The bridge plug 16 may be generically referred to as a downhole tool. A wide variety of downhole tools may be used within a wellbore in connection with producing hydrocarbons from a hydrocarbon formation. Downhole tools such as frac plugs, bridge plugs, and packers, for example, may be used to seal a component against casing along the wellbore wall or to isolate one pressure zone of the formation from another. In addition, perforating guns may be used to create perforations through casing and into the formation to produce hydrocarbons. Downhole tools are typically conveyed into the wellbore on a wireline, tubing, pipe, or another type of cable. The first tool string 8 provides for the co-deployment and co-retraction of the bridge plug 16 and the sensors 18 using a tubing 20.

Figure 2C:
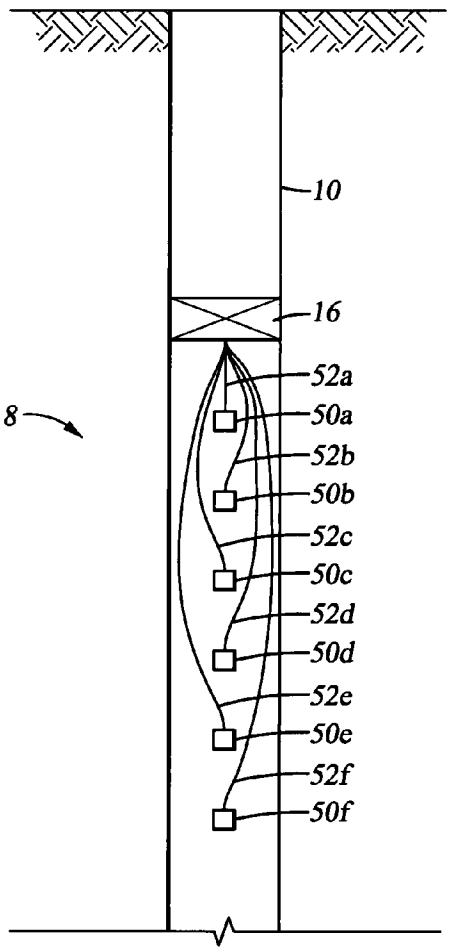
FIG. 2*c* illustrates a group of tiltmeters each tethered separately to a fracturing plug.
Figure 2B:
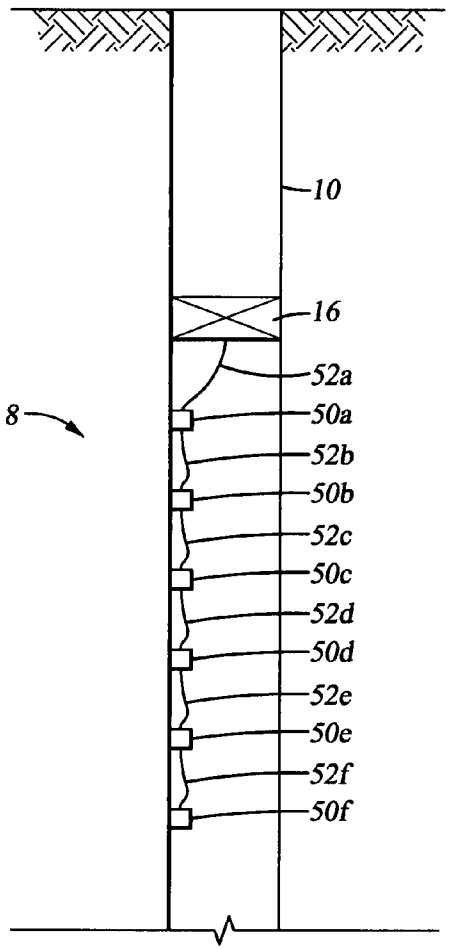
FIG. 2*b* illustrates a group of tiltmeters attached to wellbore casing.
Figure 2A:
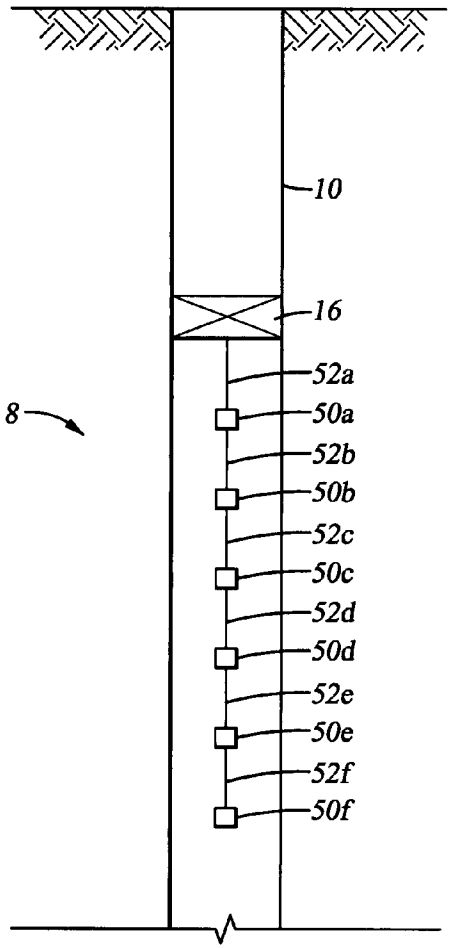
FIG. 2*a* illustrates a group of tiltmeters tethered together and hanging under a fracturing plug.

The bridge plug 16 is an isolation tool that is operable to shut the well in, to isolate the zones above and below the bridge plug 16, and to allow no fluid communication therethrough. The bridge plug 16 may be referred to as a sealable member. The sensors 18 may be tiltmeters, geophones, pressure sensors, temperature sensors, combinations thereof, or other sensors operable to sense wellbore characteristics which are known to those skilled in the art. The sensors 18 may each be supported by an individual or dedicated link or tether to the bridge plug 16 as shown in FIG. 2*c*. Alternately, the sensors 18 may be chained or linked together, as shown in FIGS. 2*a* and 2*b*, wherein sensor 18*d* is supported by a link or tether to sensor 18*c*, sensor 18*c* is supported by a link or tether to sensor 18*b*, sensor 18*b* is supported by a link or tether to sensor 18*a*, and sensor 18*a* is supported by a link or tether to the bridge plug 16. While in this exemplary case four sensors 18 are shown to be employed, in other wellbore service jobs either more or fewer sensors 18 may be employed, for example 1 or more. The embodiments of FIGS. 2*a-c* may be used with any of the tool string embodiments disclosed herein.

In the first wellbore service configuration of FIG. 1*a*, the first tool string 8 has been lowered into the wellbore 10, below the zone of interest 14, via a tubing 20. In another embodiment, the first tool string 8 may be conveyed into the wellbore 10 using wireline, slickline, coiled tubing, jointed tubing, or another conveyance known to those skilled in the art. The bridge plug 16 is placed to seal a lower boundary of the zone of interest 14.

Figure 1F:
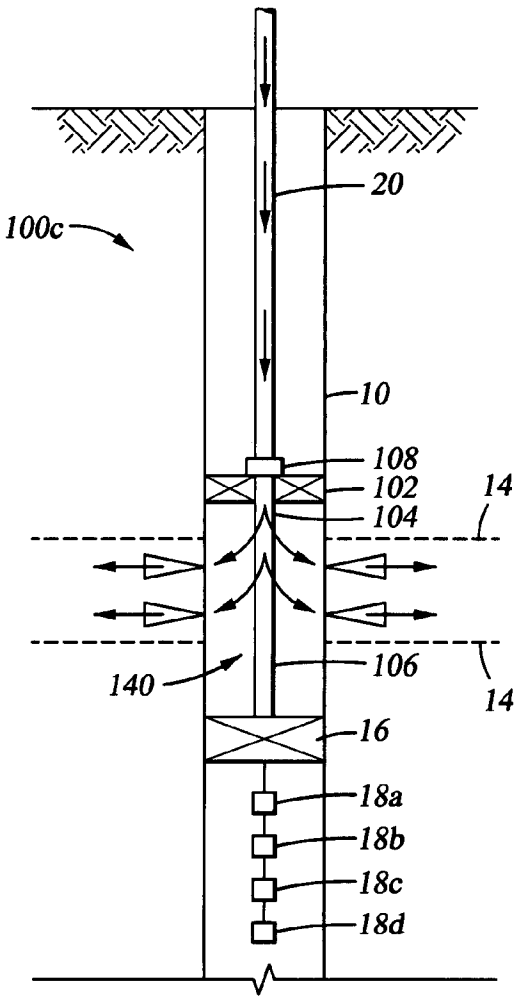
FIG. 1*f* depicts a fourth tool string and fracturing configuration.
Figure 1E:
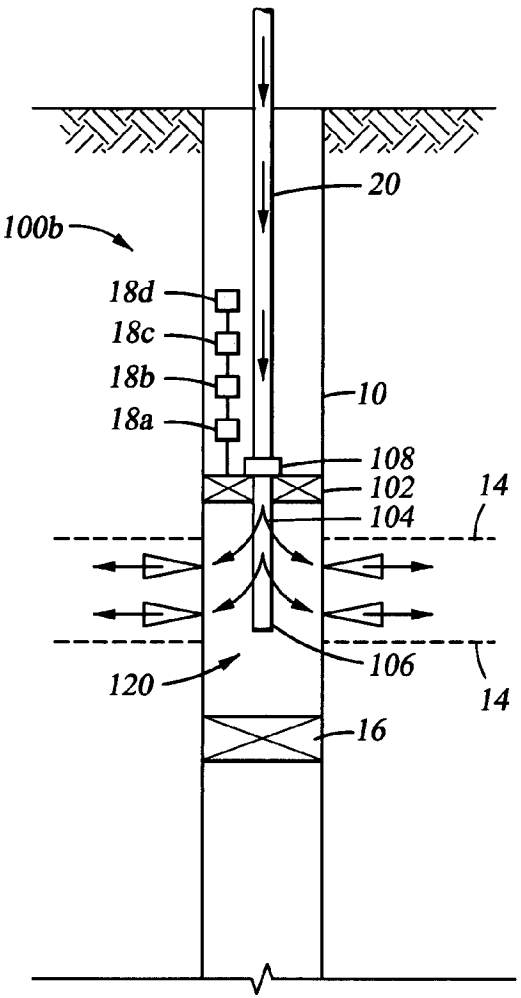
FIG. 1*e* depicts a third tool string and fracturing configuration.

In the second wellbore service configuration of FIG. 1*b*, the tubing 20 has been detached from the bridge plug 16 and withdrawn from the wellbore 10. A stimulation service pump 22 is connected to a wellhead 24 and provides a fracturing fluid or other wellbore servicing fluid at a desirable pressure, temperature, and flow rate into the wellbore 10. The fracturing fluid flows down the wellbore 10, through wellbore casing perforations, into the zone of interest 14. In an alternative embodiment as shown in FIGS. 1*h* and 1*i*, the tubing may remain attached to the sealable member 19, e.g., a packer, and the fracturing fluid may be pumped via one or more stimulation service pumps 22 into the zone of interest 14 via an internal flow path 21 inside the tubing 20, via a flow path 23 in the annular space between the outer wall of tubing 20 and the inside wall of the wellbore 10, or via both. The fracturing fluid may contain proppants or sand. A fracturing effect 26 is represented by an ellipse. During the course of the fracturing, or other wellbore service job, the sensors 18 collect data on conditions in the wellbore 10. Hanging off of the bridge plug 16 or sealable member 19, the sensors 18 are out of the flow of fracturing fluid and hence are not subject to possibly damaging ablation which may occur if proppants are employed.

In the third wellbore service configuration in FIG. 1*c*, the tubing has been run back into the wellbore 10, the tubing 20 has been reattached to the bridge plug 16, the bridge plug 16 has been disengaged from the wellbore casing, and the tubing 20 is shown withdrawing the first tool string 8 from the wellbore 10. Alternatively, prior to withdrawing the tool string from the wellbore, the tool string may be redeployed and the treatment steps repeated to fracture multiple zones or intervals. For example, as shown in FIGS. 1*h* and 1*i*, multiple zones or intervals 14*a* and 14*b* within the wellbore 10 may be fractured. While two zones are show in FIGS. 1*h* and 1*i*, it should be understood that more than two zones may be treated in a multi-stage job, and preferably the zones are perforated sequentially starting at the bottom zone and working upward. As shown in FIG. 1*h* the downhole tool is run into the wellbore via tubing 20 and the sealing member 19, e.g., a packer, is set. An array of sensors 18*a-d* is tethered to and hangs from the bottom of packer. If not already present, perforations 25 are formed by a perforating component of the downhole tool, for example a hydra-jetting tool or a perforating gun. A treatment fluid such as a fracturing fluid may be pumped, for example via the annular flow path 23, the flow path 21 inside the tubing, or both, though the perforations 25 and into the formation, thereby creating a fracturing effect 26. Upon completion of the fracturing, for example as determined via data provided by the sensor array 18*a-d*, the packer may be repositioned and reset and additional zones may be treated as shown in FIG. 1*i*.

When the first tool string 8 is removed from the wellbore 10, the sensors 18 may be operably coupled to a monitoring computer to download the data collected by the sensors 18 during the wellbore service job. The sensor data may be analyzed to model the effect of the fracture job and to adjust fracturing parameters for future fracture jobs in similar lithology. The co-deployment and co-retrieval of the bridge plug 16 and the sensors 18 saves extra trips into the wellbore 10 to deploy and retract the sensors 18.

Figure 1D:
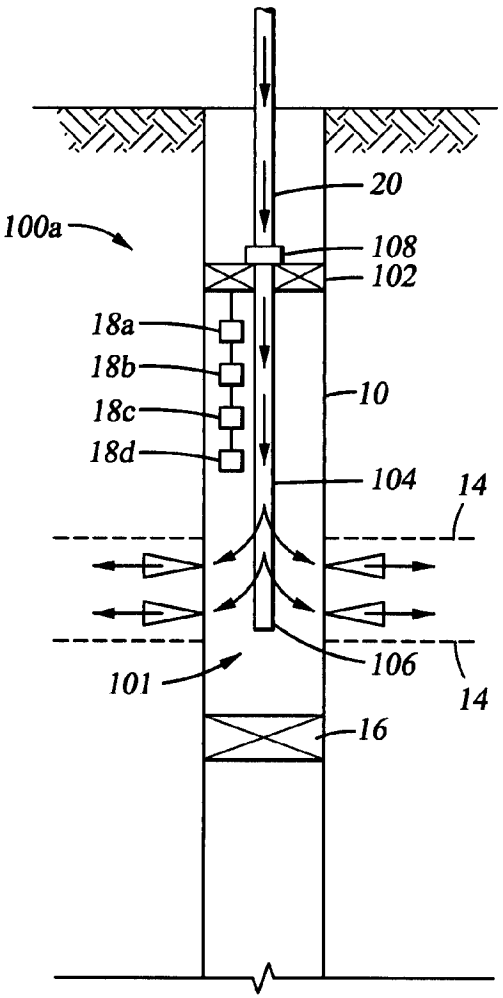
FIG. 1*d* depicts a second tool string and fracturing configuration.
Figure 1I:
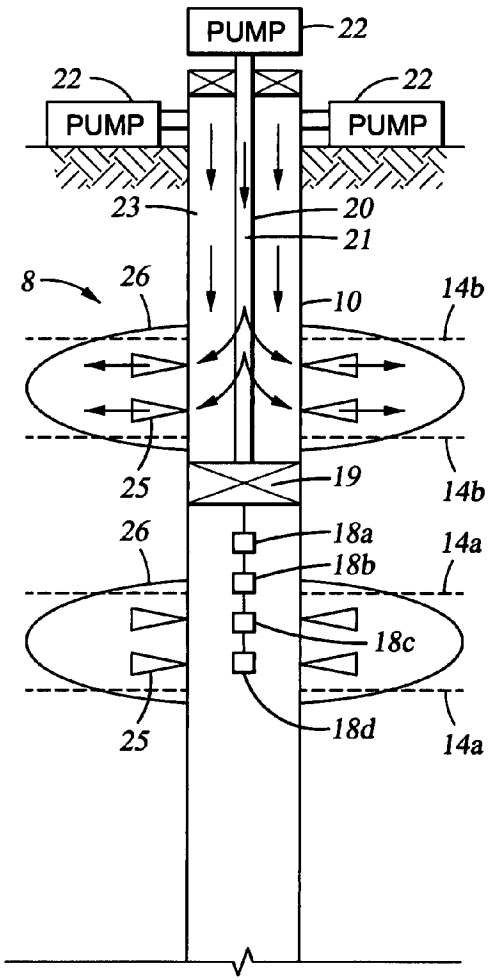
FIGS. 1*h* and 1*i* depict a sixth tool string and fracturing configuration.
Figure 1H:
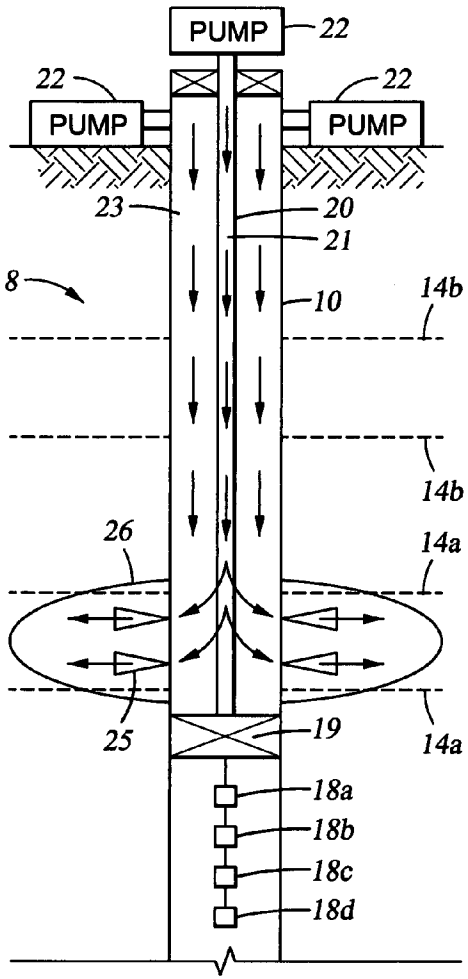

Turning now to FIG. 1*d*, a second tool string 101 is shown comprising a packer 102, a tool body 104, a plurality of jets 106, the bridge plug 16, and the plurality of sensors 18 in a fourth wellbore service configuration 100*a*. The second tool string 101 may be generically referred to as a downhole tool. The packer 102 seals between two areas of the wellbore 10 and contains a valve or conduit therethrough that permits fluid flow in one direction, as shown with arrows, when desirable. The packer 102 may be referred to as a sealable member. The jets 106 are a plurality of orifices in the tool body 104 wherefrom fracturing fluid flows under pressure. In some embodiments, the jets 106 may be inserts which are formed of special materials that resist erosion. The second tool string 101 is attached to the tubing 20 via a connector 108. The second tool string 101 is shown after having placed the bridge plug 16 to seal a lower boundary of the zone of interest 14, having disconnected from the bridge plug 16, having withdrawn from the bridge plug 16, and having placed the packer 102 to seal an upper boundary of the zone of interest 14. The use of the packer 102 and the bridge plug 16 confines the fracture fluid and pressure to the region between the packer 102 and the bridge plug 16, which may be useful when fracturing a wellbore 10 having multiple zones of interest 14 and/or multiple sets of perforations.

A fracturing job is shown in progress, with fracturing fluid, which may contain proppants, being pumped down the tubing 20, through the tool body 104, out of the jets 106, into the zone of interest 14. The sensors 18 hang down from the packer 102, out of the path of fracturing fluid flow, for example as shown in FIGS. 2*a* and 2*b*. In an embodiment, the sensors 18 may attach themselves to the wellbore wall as in FIG. 2*b*, for example tiltmeters using magnetism to attach to a wellbore casing wall. In an embodiment according to FIG. 3, the data recovery component 60 may be employed to provide electrical power to and receive data from the sensors 18 and may be located above the packer 102.

Turning now to FIG. 1*e*, a third tool string 120 is shown comprising the packer 102, the tool body 104, the jets 106, the bridge plug 16, and the plurality of sensors 18 in a fifth wellbore service configuration 100*b*. The third tool string 120 may be generically referred to as a downhole tool. The third tool string 120 is attached to the tubing 20 via the connector 108. The third tool string 120 is shown after having placed the bridge plug 16 to seal a lower boundary of the zone of interest 14, having disconnected from the bridge plug 16, having withdrawn from the bridge plug 16, and having placed the packer 102 to seal an upper boundary of the zone of interest 14. The use of the packer 102 and the bridge plug 16 confines the fracture fluid and pressure to the region between the packer 102 and the bridge plug 16, which may be useful when fracturing a wellbore 10 having multiple zones of interest 14 and/or multiple sets of perforations.

A fracturing job is shown in progress, with fracturing fluid, which may contain proppants, being pumped down the tubing 20, through the tool body 104, out of the jets 106, into the zone of interest 14. The sensors 18 hang above the packer 102, out of the path of fracturing fluid flow, suspended in the wellbore fluid due to buoyancy or through the action of a propulsion action. In an embodiment, the sensors may attach themselves to the wellbore wall as in FIG. 2*b*, for example tiltmeters using magnetism to attach to a wellbore casing wall. In an embodiment according to FIG. 3, the data recovery component 60 may be employed to provide electrical power to and receive data from the sensors 18 and may be located above the packer 102.

Turning now to FIG. 1*f*, a fourth tool string 140 is shown comprising the packer 102, the tool body 104, the jets 106, the bridge plug 16, and the sensors 18 in a sixth wellbore service configuration 100*c*. The fourth tool string 140 may be generically referred to as a downhole tool. The fourth tool string 140 is attached to the tubing 20 via the connector 108. The fourth tool string 140 is shown after having placed the bridge plug 16 to seal a lower boundary of the zone of interest 14 and having placed the packer 102 to seal an upper boundary of the zone of interest 14. The use of the packer 102 and the bridge plug 16 confines the fracture fluid and pressure to the region between the packer 102 and the bridge plug 16, which may be useful when fracturing a wellbore 10 having multiple zones of interest 14 and/or multiple sets of perforations.

A fracturing job is shown in progress, with fracturing fluid, which may contain proppants, being pumped down the tubing 20, through the tool body 104, out of the jets 106, into the zone of interest 14. The sensors 18 hang below the bridge plug 16, out of the path of fracturing fluid flow, for example as shown in FIGS. 2*a* and 2*b*. In an embodiment, the sensors may attach themselves to the wellbore wall as in FIG. 2*b*, for example tiltmeters using magnetism to attach to a wellbore casing wall. In an embodiment according to FIG. 3, the data recovery component 60 may be employed to provide electrical power to and receive data from the sensors 18 and may be located below the bridge plug 16.

Figure 1G:
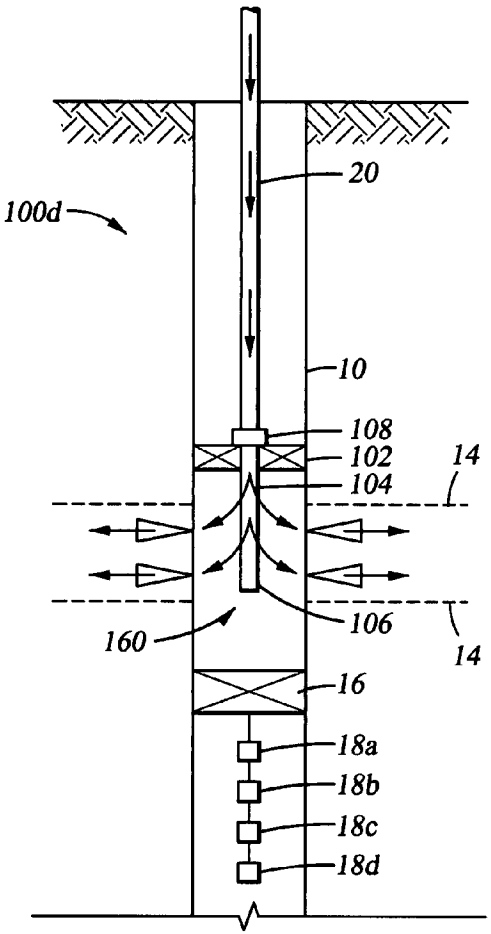
FIG. 1*g* depicts a fifth tool string and fracturing configuration.

Turning now to FIG. 1*g*, a fifth tool string 160 is shown comprising the packer 102, the tool body 104, the jets 106, the bridge plug 16, and the sensors 18 in a seventh wellbore service configuration 100*d*. The fifth tool string 160 may be generically referred to as a downhole tool. The fifth tool string 160 is attached to the tubing 20 via the connector 108. The fifth tool string 160 is shown after having placed the bridge plug 16 to seal a lower boundary of the zone of interest 14, having disconnected from the bridge plug 16, having withdrawn from the bridge plug 16, and having placed the packer 102 to seal an upper boundary of the zone of interest 14. The use of the packer 102 and the bridge plug 16 confines the fracture fluid and pressure to the region between the packer 102 and the bridge plug 16, which may be useful when fracturing a wellbore 10 having multiple zones of interest 14 and/or multiple sets of perforations.

A fracturing job is shown in progress, with fracturing fluid, which may contain proppants, being pumped down the tubing 20, through the tool body 104, out of the jets 106, into the zone of interest 14. The sensors 18 hang below the bridge plug 16, out of the path of fracturing fluid flow, for example as shown in FIGS. 2*a* and 2*b*. In an embodiment, the sensors may attach themselves to the wellbore wall as in FIG. 2*b*, for example tiltmeters using magnetism to attach to a wellbore casing wall. In an embodiment according to FIG. 3, the data recovery component 60 may be employed to provide electrical power to and receive data from the sensors 18 and may be located below the bridge plug 16.

Each of the tool strings may be referred to generally as a downhole tool. While the exemplary wellbore service jobs described above referred to using a bridge plug 16 and a packer 102 in various tool string configurations, those skilled in the art will readily appreciate that other sealable members may be employed to conduct fracturing wellbore service jobs as well as other wellbore service jobs. Other dispositions of the sensors 18 out of the flow of fracture fluid are also contemplated by this disclosure.

Turning now to FIG. 2*a*, the first tool string 8 is shown in the wellbore 10 with six tiltmeters (or other appropriate sensors)—a first tiltmeter 50*a*, a second tiltmeter 50*b*, a third tiltmeter 50*c*, a fourth tiltmeter 50*d*, a fifth tiltmeter 50*e*, and a sixth tiltmeter 50*f*-attached to and hanging below the bridge plug 16, not attached to the wellbore 10. The first tiltmeter 50*a* is attached to the bridge plug 16 by a first link 52*a*. The second tiltmeter 50*b* is attached to the first tiltmeter 50*a* by second link 52*b*. The third tiltmeter 50*c* is attached to the second tiltmeter 50*b* by a third link 52*c*. The fourth tiltmeter 50*d* is attached to the third tiltmeter 50*c* by a fourth link 52*d*. The fifth tiltmeter 50*e* is attached to the fourth tiltmeter 50*d* by a fifth link 52*e*. The sixth tiltmeter 50*f* is attached to the fifth tiltmeter 50*e* by a sixth link 52*f*.

Turning now to FIG. 2*b*, the wellbore 10 is shown with the tiltmeters 50 *a-f* attached to the wellbore casing and with desirable slack in each of the links 52 *a-f*. The slack in each of the links 52 *a-f* mechanically isolates the tiltmeters 50 *a-f* from one another and from the bridge plug 16. The slack may be imparted to the links 52 *a-f* by performing a maneuver wherein the bridge plug 16 is lowered more quickly than the tiltmeters 50 *a-f* can fall in suspension in the fluid in the wellbore 10, the tiltmeters 50 *a-f* are attached to the wellbore 10, and the bridge plug 16 deploys and seals the wellbore 10. The tiltmeters 50 *a-f* may be designed to deploy a drag structure and/or to increase their buoyancy whereby to slow the descent of the tiltmeters 50 *a-f* in the fluid in the wellbore 10. The drag structure also may be employed to orient the tiltmeters 50 *a-f* and to steer them towards the wellbore casing where the tiltmeters 50 *a-f* may attach to the wellbore casing, for example employing magnets.

In another embodiment, the tiltmeters 50 *a-f* may hang in tension, suspended by the links 52 *a-f* and simultaneously attached to the wellbore casing without slack in the links.

The links 52 *a-f* may be chain links; rope wire, or cable tethers; bands, or data transmission cables formed of metal, plastic, rubber, ceramic, composite materials, or other materials known to those skilled in the art. The sensors 50 *a-f* may separate the links 52*a-f*, forming part of the weight bearing structure supporting sensors located below. Alternately, the links 52 *a-f* may form a continuous chain or tether, and sensors 50 *a-f* may be attached thereto without forming part of the weight bearing structure. The links 52 *a-f* may also serve as data communication pathways between the sensors 50 *a-f* and a memory module 60, as in FIG. 3*a*.

The discussion of how the sensors 50 *a-f* are suspended from the bridge plug 16 and attached to the wellbore casing also applies to the alternative tool strings illustrated in FIGS. 1*d-i*.

Figure 3B:
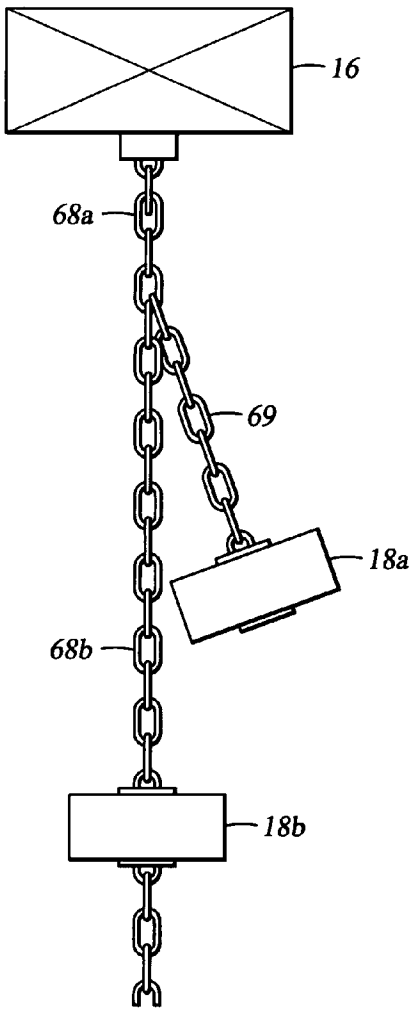
FIG. 3*b* depicts an embodiment for tethering a sensor.
Figure 3A:
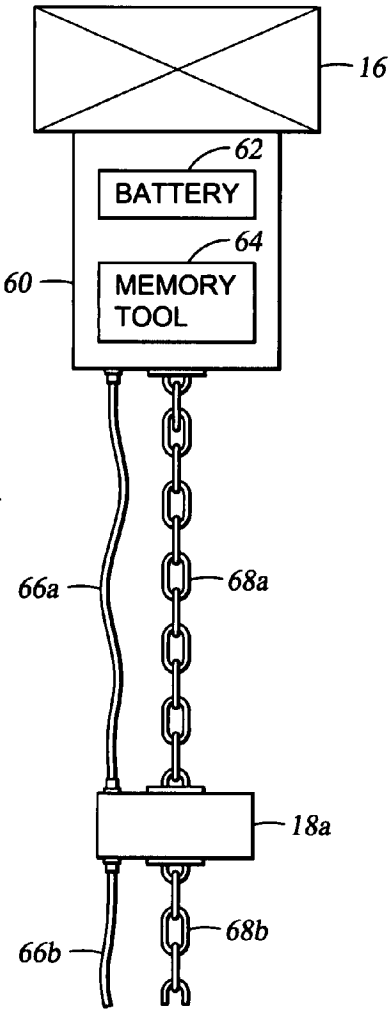
FIG. 3*a* depicts a data recovery component.

Turning now to FIG. 3*a*, in some embodiments of the first tool string 8 a data recovery component 60 may attached as shown to the bottom of the bridge plug 16. The data recovery component 60 comprises a battery 62 and a memory tool 64. The battery 62 provides electrical power via a first cable 66*a* to the first sensor 18*a*. The memory tool 64 communicates with and receives data from the first sensor 18*a* through the first cable 66*a* and stores this data, to be downloaded by a monitoring computer at the surface when the first tool string 8 is withdrawn from the wellbore 10. In some embodiments, the memory tool 64 may provide data collection commands, data collection timing signals, and or excitation signals to the sensors 18 through the first cable 66*a*.

The memory tool 64 may be a data recording device such as for example a microcontroller/microprocessor associated with a memory and operable to receive and store data from the sensors 18. Electrical power is provided to and data is returned from each of the sensors 18 through a path comprising the first cable 66*a*, the first sensor 18*a*, a second cable 66*b* attached between the first sensor 18*a* and the second sensor 18*b*, the second sensor 18*b*, a third cable 66*c* attached between the second sensor 18*b* and the third sensor 18*c*, the third sensor 18*c*, a fourth cable 66*d* attached between the third sensor 18*c* and the fourth sensor 18*d*, and the fourth sensor 18*d*.

A first chain 68*a* is shown supporting the weight of the sensors 18. The first chain 68*a* is shown attached to the data recovery component 60, but in some embodiments the first chain 68*a* may attach to the bridge plug 16. A second chain 68*b*, a third chain 68*c* (not shown), and a fourth chain 68*d* (not shown) are interconnected through the bodies of the sensors 18 and support the weight of the sensors 18. In an alternate embodiment as shown in FIG. 3*b*, the chains 68 attach to each other to form a continuous chain and the sensors attach thereto via attachment 69 without bearing any of the weight. The chains 68 may be constructed of metal, plastic, ceramic, or other materials. Support linkages other than chain also are contemplated, such as a flexible chord.

In some embodiments, the cable 66 and the chain 68 attached to each sensor 18 may attach directly to the data recovery component 60. In an embodiment, the cable 66 may be a continuous cable with Tee-like drop connections provided along the length of the continuous cable for coupling to the sensors 18. In some embodiments the cable 66 and the chain 68 may be enclosed in a sheath to prevent entanglements and to protect the cable 66 and chain 68 from hazards in the wellbore 10. The cable 66 may be interwoven in the chain 68. In an embodiment, the cable 66 may be integrated with the chain 68 or a tether.

The discussion of the data recovery component 60 also applies to the alternative tool strings illustrated in FIGS. 1*d-i*.

In some embodiments, a communication path may be provided between the surface and the downhole tool 16 and/or the sensors 18. The communication path may be contained by the tubing, for example provided by a cable inside or embedded in the walls of the tubing 20. In addition to or alternatively, the communication path may be provided by a wireless link such as radio link, an optical link, and/or an acoustic link through the fluid in the wellbore 10.

A communication path between the surface and the second tool string 101, the third tool string 120, and the fourth tool string 140, for example through a cable inside or embedded in the walls of the tubing 20 to a monitoring computer located at the surface, may be provided by the tubing 20. This capability, which may be termed a real-time fracture monitoring capability or near real-time fracture monitoring capability, could be employed to monitor a wellbore servicing operation such as detecting pumping of fracturing fluid into a water bearing formation. Pumping fracturing fluid into a water bearing formation increases flow of water, which is generally not desirable. Being able to detect this event permits stopping the fracturing job and minimizing the fracturing of the water bearing formation. Additionally, this real-time or near real-time fracture monitoring capability may be employed to adaptively control the fracture job, such as stopping pumping of fracturing fluid after data from the sensors 18 fed into a fracture model generated by the monitoring computer indicates an optimal fracture stage has been arrived at.

In an embodiment, an acoustic communication link between the surface and the first tool string 8, such as using hydraulic telemetry, may be established. This communication link may be used to monitor fracturing processes while fracturing is in progress as described above.

In one embodiment, a communication path between the surface and the fifth tool string 160 by providing a connectionless communication link between the bridge plug 16 and the packer 102 and by providing a connected communication link, for example a wire cable within the tubing 20, from the packer 102 to the surface. The connectionless communication link may be provided by a radio link, an optical link, or an acoustic link, such as using hydraulic telemetry, through the fluid between the bridge plug 16 and the packer 102. The communication path between the bridge plug 16 and the surface may support the ability to monitor fracturing processes while fracturing is in progress as described above.

In other embodiments, a combination of these communication link technologies may be employed to provide the ability to monitor fracturing processes or other wellbore service operations in real-time or near real-time.

Figure 4:
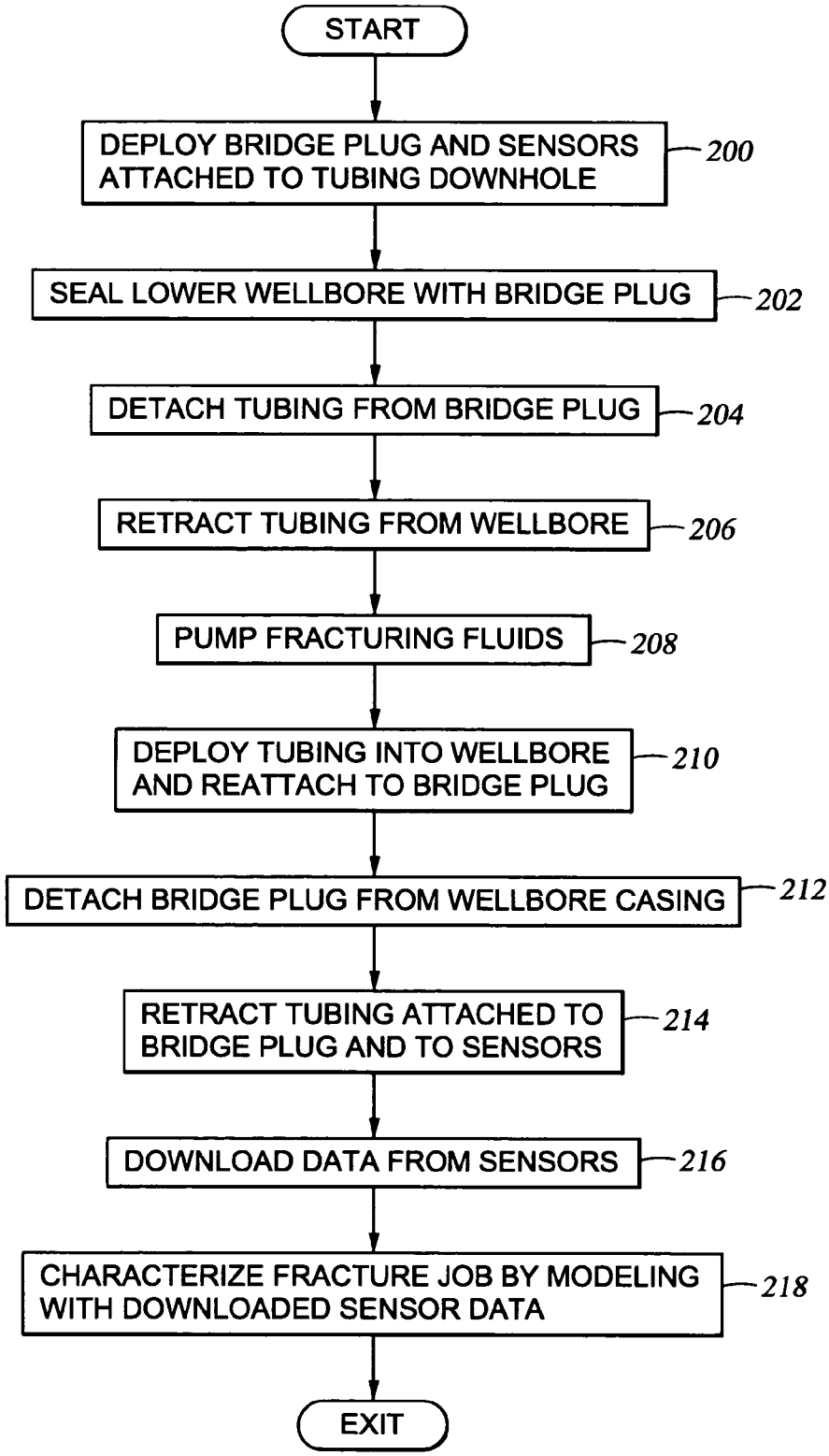
FIG. 4 is a flow chart illustrating a first method for monitoring a wellbore service treatment.

Turning now to FIG. 4, a flow chart is shown of a first method for using the various tool strings of the present disclosure such as shown in FIGS. 1*a-c*. The first method begins at block 200 where a sealing member such as the bridge plug 16 or a packer, the sensors 18, and the tubing 20 are co-deployed downhole. The first method proceeds to block 202 where the bridge plug 16 is seated in the wellbore casing and seals the wellbore 10 below the bridge plug 16 from the wellbore 10 above the bridge plug 16. The first method proceeds to block 204 where the tubing 20 detaches from the bridge plug 16. The first method proceeds to block 206 where the tubing 20 is retracted from the wellbore 10.

The first method proceeds to block 208 where a wellbore service procedure such as a fracturing job is conducted. This involves pumping fracturing fluid down the wellbore 10 at the appropriate pressure, temperature, and flow rate with the appropriate mix of materials, such as proppants and fluids. The parameters for a specific fracturing job are engineered for a specific lithology or field based on experience and data obtained during previous fracture jobs, as is well known to those skilled in the art. Upon completion of pumping, the first method proceeds to block 210 where the tubing 20 is deployed into the wellbore 10 and reattaches to the bridge plug 16.

The first method proceeds to block 212 where the bridge plug 16 detaches from the wellbore casing. The first method proceeds to block 214 where the tubing 20 is retracted from the wellbore 10, drawing out with it the bridge plug 16 and the sensors 18.

The first method proceeds to block 216 where the data collected by the sensors 18 is downloaded to a first computer system. The first method proceeds to block 218 where the data downloaded from the sensors is employed to characterize the fracture job by modeling on a second computer system. This first and second computer systems may be the same computer, or they may be different computers. The characterization of the fracture job of block 218 may occur at the location of the wellbore 10 or it may occur away from the location of the wellbore 10, for example at a headquarters or at an office.

Observe that the first method described above saves extra trips into the wellbore 10 to deploy and retrieve the sensors 18, for example using a wireline equipment. In the first method the sensors 18 are co-deployed and co-retracted with the bridge plug 16.

Figure 5:
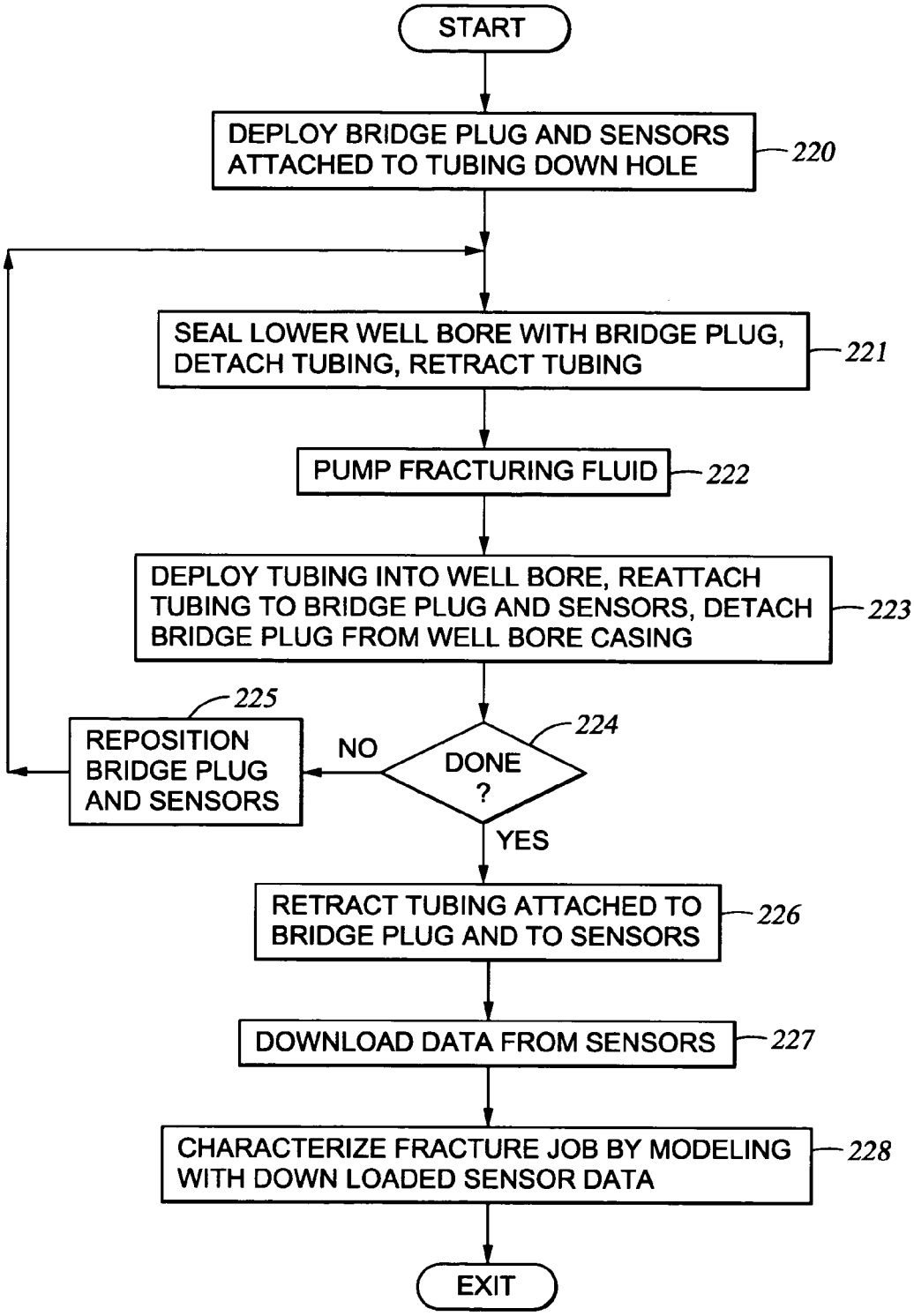
FIG. 5 is a flow chart illustrating a second method for monitoring a wellbore service treatment.

Turning now to FIG. 5, a flow chart is shown of a second method for using the various tool strings of the present disclosure such as is shown in FIGS. 1*h* and 1*i*. The second method is related to the first method but is different by providing fracturing of multiple zones within the wellbore 10. The second method begins at block 220 where a sealing member such as the bridge plug 16 or a packer, the sensors 18, and the tubing 20 are co-deployed downhole. The second method proceeds to block 221 where the bridge plug 16 is seated in the wellbore casing and seals the wellbore 10 below the bridge plug 16 from the wellbore 10 above the bridge plug 16; where the tubing 20 detaches from the bridge plug 16; and where the tubing 20 is retracted from the wellbore 10.

The first method proceeds to block 222 where a wellbore service procedure such as a fracturing job is conducted. This involves pumping fracturing fluid down the wellbore 10 at the appropriate pressure, temperature, and flow rate with the appropriate mix of materials, such as proppants and fluids. The parameters for a specific fracturing job are engineered for a specific lithology or field based on experience and data obtained during previous fracture jobs, as is well known to those skilled in the art. Upon completion of pumping, the second method proceeds to block 223 where the tubing 20 is deployed into the wellbore 10, the tubing 20 reattaches to the bridge plug 16, and the bridge plug 16 detaches from the wellbore casing.

The second method proceeds to block 224 where if another zone of the wellbore 10 remains to be fractured, the second method proceeds to block 225. In block 225 the bridge plug 16 and sensors 18 are repositioned to fracture the next zone of the wellbore 10, for example at a position further out of the wellbore 10. The second method proceeds to block 221. By repeatedly looping through blocks 221, 222, 223, 224, and 225 multiple zones of the wellbore 10 may be fractured. Note that the sensors 18 attached to the bridge plug 16 are not deployed into and retracted from the wellbore 10 between each of the fracturing operations, thus saving numerous extra trips into and out of the wellbore 10. The sensors 18 detect, collect, and store data for each of the multiple fracturing operations.

In block 224 if no additional zones of the wellbore 10 remain to be fractured, the second method proceeds to block 226 where the tubing 20 is retracted from the wellbore 10, drawing out with it the bridge plug 16 and the sensors 18.

The second method proceeds to block 227 where the data collected by the sensors 18 is downloaded to a first computer system. The second method proceeds to block 228 where the data downloaded from the sensors is employed to characterize the multiple fracture jobs by modeling on a second computer system. This first and second computer systems may be the same computer, or they may be different computers. The characterization of the fracture job of block 228 may occur at the location of the wellbore 10 or it may occur away from the location of the wellbore 10, for example at a headquarters or at an office.

Observe that the second method described above saves multiple extra trips into the wellbore 10 to deploy and retrieve the sensors 18, for example using wireline equipment. In the second method the sensors 18 are co-deployed and co-retracted with the bridge plug 16.

Figure 6:
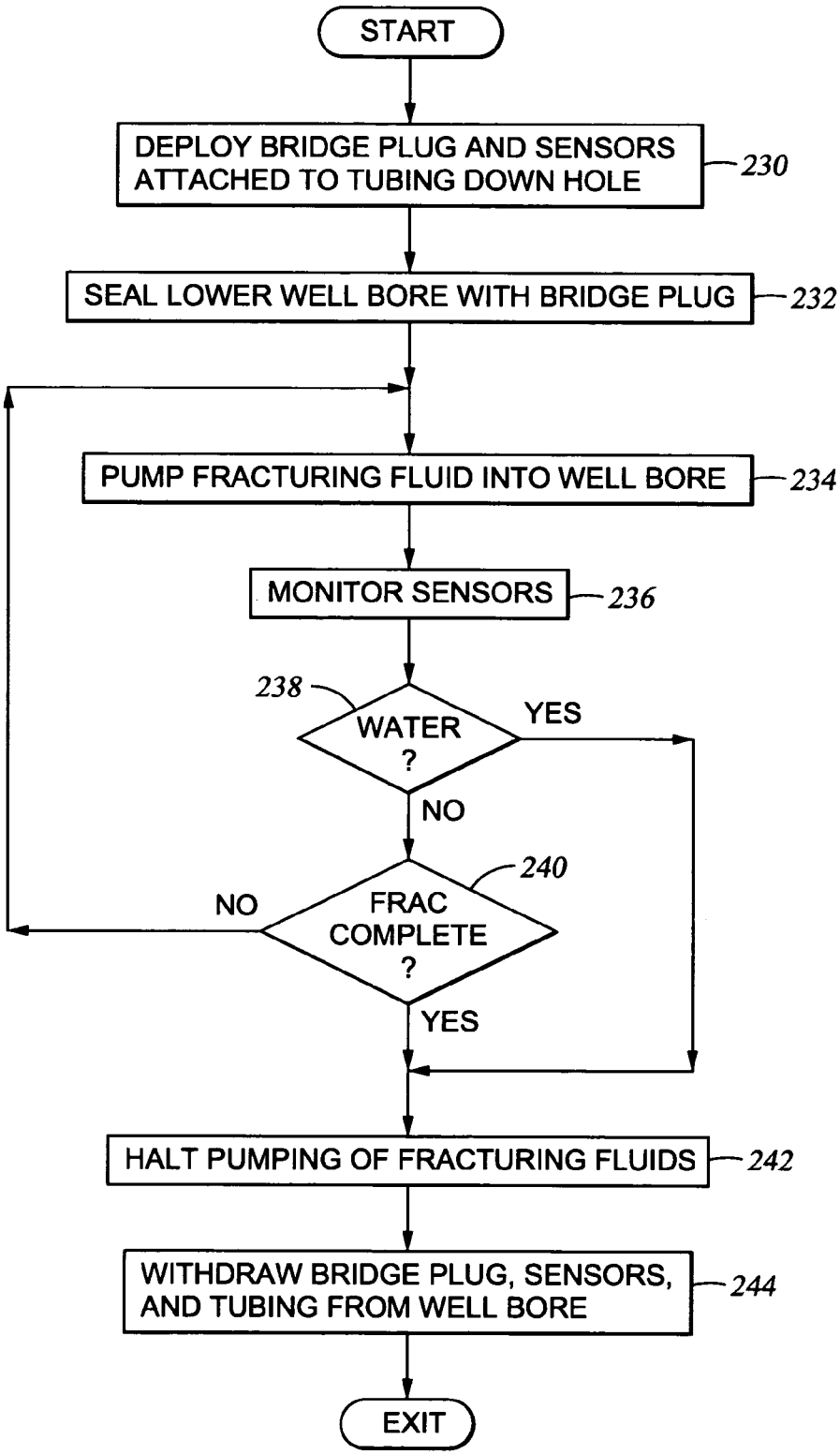
FIG. 6 is a flow chart illustrating a third method for monitoring a wellbore service treatment.

Turning now to FIG. 6, a flow chart is shown of a third method for using the various tool strings of the present disclosure such as second tool string 101, the third tool string 120, the fourth tool string 140, or the fifth tool string 160. The third method begins at block 230 where a sealing member such as the bridge plug 16 or a packer, the sensors 18, the first tool string 101, and the tubing 20 are deployed into the wellbore 10. The third method proceeds to block 232 where the bridge plug 16 is seated in the wellbore casing and seals the wellbore 10 below the bridge plug 16 from the wellbore 10 above the bridge plug 16.

The third method proceeds to block 234 where a fracturing job is started. This involves pumping fracturing fluid down the wellbore 10 at the appropriate pressure, temperature, and flow rate with the appropriate mix of materials, such as proppants and fluids, as is well known to those skilled in the art.

The third method proceeds to block 236 where the sensors 18 are monitored at the surface by a first computer system. The monitoring includes gathering data from each of the sensors 18 and analyzing the gathered data. Analysis may include feeding the gathered data into a fracture model which predicts fracture progress based on a history of sensor data. The results of the analyzing the gathered data provides input to fracture job operators making a decision to continue pumping fracturing fluid, to stop pumping fracturing fluid, and perhaps to change the material mix of the fracturing fluid or other fracture job parameters such as pressure, temperature, and flow rate.

In an embodiment, in block 236 the pumping of fracturing fluid into the wellbore is completely ceased. Substantial vibration may be produced in the wellbore by the pumping of fracturing fluid, and this vibration may interfere with the sensors 18 monitoring the progress of the fracturing job. In another embodiment, in block 236 the pumping of fracturing fluid continues.

The third method proceeds to block 238 where if the fracturing fluid is not being pumped into a water bearing formation the third method proceeds to block 240. In block 240, if the fracture job is not complete, the third method returns to block 234 and the fracture job continues.

If in block 238 the fracturing fluid is being pumped into a water bearing formation the third method proceeds to block 242. Similarly, if in block 240 the fracturing job is complete the third method proceeds to block 242. In block 242 the pumping of fracturing fluid is stopped. The third method proceeds to block 244 where the bridge plug 16 detaches from the wellbore casing, and the tubing 20 is retracted from the wellbore 10, drawing out with it the first tool string 101, the bridge plug 16, and the sensors 18.

Observe that the third method described above saves extra trips into the wellbore 10 to deploy and retrieve the sensors 18, for example using wireline equipment. In the third method the sensors 18 are co-deployed with the first tool string 101 or with the bridge plug 16 and co-retracted with the first tool string 101 or with the bridge plug 16. Additionally, the third method permits on-location adaptation of fracture job plans to better accord with the circumstances detected, in real-time or near real-time, by the sensors 18.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein, but may be modified within the scope of the appended claims along with their full scope of equivalents. For example, the various elements or components may be combined or integrated in another system or certain features may be omitted, or not implemented.

Also, techniques, systems, subsystems and methods described and illustrated in the various embodiments as discreet or separate may be combined or integrated with other systems, modules, techniques, or methods without departing from the scope of the present disclosure. Other items shown as directly coupled or communicating with each other may be coupled through some interface or device, such that the items may no longer be considered directly coupled to each but may still be indirectly coupled and in communication with one another. Other examples of changes, substitutions, and alterations are ascertainable by one skilled in the art and could be made without departing from the spirit and scope disclosed herein.

What is claimed is:

1. A system for monitoring a wellbore service treatment, comprising:

a downhole tool operable to perform the wellbore service treatment, the downhole tool comprising a sealable member;

a conveyance connected to the downhole tool for moving the downhole tool in the wellbore and separable from the sealable member; and a plurality of sensors operable to provide one or more wellbore indications and attached to the sealable member via one or more tethers both with the conveyance connected to and separated from the sealable member;

wherein the sealable member is selected from the group consisting of a bridge plug, a frac plug, a packer, or combinations thereof.

2. The system of claim 1 wherein one or more of the sensors is attached via a dedicated tether.

3. The system of claim 1 wherein two or more of the sensors are entrained via the tethers.

4. The system of claim 3 wherein one or more of the entrained sensors are connected to the tether and bear all or a portion of the weight of a sensor below.

5. The system of claim 3 wherein one or more of the entrained sensors are connected to the tether such that the tether, rather than the connected sensor, bears all or a portion of the weight of a sensor below.

6. The system of claim 1 wherein one or more of the sensors hang down from the sealable member.

7. The system of claim 1 wherein one or more of the sensors are further attached to a wellbore wall.

8. The system of claim 7 wherein the sensors are magnetically attached to a casing of the wellbore.

9. The system of claim 7 wherein the sensors are attached to the wellbore wall such that there is slack in the tether.

10. The system of claim 7 wherein the sensors are attached to the wellbore wall such that there is no slack in the tether.

11. The system of claim 1 wherein the sensors are positioned relative to the downhole tool so as to be substantially clear of a flow path of a service fluid employed in the wellbore service treatment.

12. The system of claim 1 wherein the wellbore service treatment comprises a stimulation treatment.

13. The system of claim 1 wherein the wellbore service treatment comprises a fracturing treatment.

14. The system of claim 13 wherein one or more of the sensors float up from the sealable member.

15. The system of claim 13 wherein one or more of the sensors hang down from the sealable member.

16. The system of 15 wherein the sensors are magnetically attached to a casing of the wellbore.

17. The system of claim 16 wherein one or more of the sensors are attached via a dedicated tether.

18. The system of claim 16 wherein two or more of the sensors are entrained via the tethers.

19. The system of claim 18 wherein the tethers are selected from a group consisting of a chain, a rope, a band, a cable, or combinations thereof.

20. The system of claim 19 wherein the sensors are selected from the group consisting of geophones, tiltmeters, pressure sensors, temperature sensors, or combinations thereof.

21. The system of claim 20 wherein the conveyance is tubing and the service fluid for the fracturing treatment is displaced into the wellbore via a flow path inside the tubing, outside the tubing, or both.

22. The system of claim 1 wherein the tethers are selected from the group consisting of a chain, a rope, a band, a cable, or combinations thereof.

23. The system of claim 1 wherein the tether is sheathed.

24. The system of claim 1 wherein the sensors are selected from the group consisting of geophones, tiltmeters, pressure sensors, temperature sensors, or combinations thereof.

25. The system of claim 1 one or more of the sensors comprise a drag structure such that the sensors drag opposite a direction of movement of the downhole tool in the wellbore.

26. The system of claim 1 further comprising:

a monitor component; and a communication link between the sensors and the monitor component, wherein the monitor component is operable to receive the wellbore indications and to monitor the wellbore service treatment.

27. The system of claim 26 wherein the communication link is contained by the conveyance.

28. The system of claim 26 wherein the communication link is selected from the group consisting of a wireless communication link, a wired communication link, an optical communication link, an acoustic communication link, or combinations thereof.

29. The system of claim 1 further comprising:

a memory tool in communication with the sensors and operable to store the wellbore indications, wherein the memory tool is mechanically coupled to at least a component of the downhole tool;

a battery operable to provide electrical power to the memory tool, wherein the battery is mechanically coupled to at least a component of the downhole tool; and a monitor component located at the surface and operable to receive the wellbore indications from the memory tool.

30. A system for monitoring a wellbore service treatment, comprising:

a downhole tool operable to perform the wellbore service treatment, the downhole tool comprising a sealable member;

a conveyance connected to the downhole tool for moving the downhole tool in the wellbore and separable from the sealable member; and a plurality of sensors operable to provide one or more wellbore indications and attached to the sealable member via one or more tethers both with the conveyance connected to and separated from the sealable member, wherein one or more of the sensors float up from the sealable member.

31. A method of monitoring a wellbore service treatment, comprising:

conveying into a wellbore with a conveyance:

a downhole tool operable to perform the wellbore service treatment, the downhole tool comprising a sealable member separable from the conveyance, wherein the sealable member is selected from the group consisting of a bridge plug, a frac plug, a packer, or combinations thereof; and a plurality of sensors operable to provide one or more wellbore indications attached to the sealable member via one or more tethers both with the conveyance connected to and separated from the sealable member;

deploying the downhole tool at a first position in the wellbore for service;

treating the wellbore at the first position; and monitoring an at least one wellbore indication provided by the wellbore sensors at the first position.

32. The method of claim 31 wherein the sensors are positioned relative to the downhole tool so as to be substantially clear of a flow path of a service fluid employed in the wellbore service treatment.

33. The method of claim 32 wherein deploying the downhole tool comprises:

sealing a lower boundary of a zone of interest with the sealable member; and sealing an upper boundary of the zone of interest with a second sealable member, wherein one or more of the sensors hang down from the sealable member, the second sealable member, or both.

34. The method of claim 32 wherein deploying the downhole tool comprises:

sealing a lower boundary of a zone of interest with the sealable member; and sealing an upper boundary of the zone of interest with a second sealable member, wherein one or more of the sensors float up from the sealable member, the second sealable member, or both.

35. The method of claim 31 wherein the wellbore service treatment comprises a stimulation treatment.

36. The method of claim 31 wherein the wellbore service treatment comprises a fracturing treatment.

37. The method of claim 36 wherein one or more of the sensors float up from the sealable member.

38. The method of claim 36 wherein one or more of the sensors hang down from the sealable member.

39. The method of 38 wherein the sensors are magnetically attached to a casing of the wellbore.

40. The method of claim 39 wherein one or more of the sensors are attached via a dedicated tether.

41. The method of claim 39 wherein two or more of the sensors are entrained via the tethers.

42. The method of claim 41 wherein the tethers are selected from the group consisting of a chain, a rope, a band, a cable, or combinations thereof.

43. The method of claim 42 wherein the sensors are selected from the group consisting of geophones, tiltmeters, pressure sensors, temperature sensors, or combinations thereof.

44. The method of claim 43 wherein the downhole tool is conveyed via tubing and the service fluid for the fracturing treatment is displaced into the wellbore via a flow path inside the tubing, outside the tubing, or both.

45. The method of claim 31 wherein one or more of the sensors comprise a drag structure such that the sensors drag opposite a direction of movement of the downhole tool in the wellbore.

46. The method of claim 31 further comprising:

storing the at least one wellbore indication provided by the wellbore sensors in a memory tool; and downloading the at least one wellbore indication from the memory tool to a monitor component located at the surface.

47. The method of claim 31 further comprising transmitting the at least one wellbore indication provided by the wellbore sensors to a monitor component located at the surface.

48. A method of monitoring a wellbore service treatment, comprising:

conveying into a wellbore with a conveyance:

a downhole tool operable to perform the wellbore service treatment, the downhole tool comprising a sealable member separable from the conveyance; and a plurality of sensors operable to provide one or more wellbore indications attached to the sealable member via one or more tethers both with the conveyance connected to and separated from the sealable member;

deploying the downhole tool at a first position in the wellbore for service;

treating the wellbore at the first position; and monitoring an at least one wellbore indication provided by the wellbore sensors at the first position and further comprising:

redeploying the downhole tool to one or more different positions in the wellbore;

treating the wellbore at the different positions; and monitoring an at least one wellbore indication provided by the wellbore sensors at the different positions.

49. The method of claim 48 wherein the wellbore service treatment comprises a fracturing treatment and the redeploying the downhole tool comprises moving the downhole tool up the wellbore to fracture multiple zones of the wellbore.

50. A method of monitoring a wellbore service treatment, comprising:

conveying into a wellbore with a conveyance:

a downhole tool operable to perform the wellbore service treatment, the downhole tool comprising a sealable member separable from the conveyance; and a plurality of sensors operable to provide one or more wellbore indications attached to the sealable member via one or more tethers both with the conveyance connected to and separated from the sealable member;

deploying the downhole tool at a first position in the wellbore for service;

treating the wellbore at the first position; and monitoring an at least one wellbore indication provided by the wellbore sensors at the first position;

wherein deploying the downhole tool comprises:

sealing a lower boundary of a zone of interest with the sealable member; and sealing an upper boundary of the zone of interest with a second sealable member, wherein one or more of the sensors hang down from the sealable member, the second sealable member, or both.

51. A method of monitoring a wellbore service treatment, comprising:

conveying into a wellbore with a conveyance:

a downhole tool operable to perform the wellbore service treatment, the downhole tool comprising a sealable member separable from the conveyance; and a plurality of sensors operable to provide one or more wellbore indications attached to the sealable member via one or more tethers both with the conveyance connected to and separated from the sealable member;

deploying the downhole tool at a first position in the wellbore for service;

treating the wellbore at the first position; and monitoring an at least one wellbore indication provided by the wellbore sensors at the first position;

wherein deploying the downhole tool comprises:

sealing a lower boundary of a zone of interest with the sealable member; and sealing an upper boundary of the zone of interest with a second sealable member, wherein one or more of the sensors float up from the sealable member, the second sealable member, or both.

52. A method of monitoring a wellbore service treatment, comprising:

conveying into a wellbore with a conveyance:

a downhole tool operable to perform the wellbore service treatment, the downhole tool comprising a first sealable member separable from the conveyance and a second sealable member; and a plurality of sensors operable to provide one or more wellbore indications attached to the first sealable member, the second sealable member, or both via one or more tethers both with the conveyance connected to and separated from the sealable member;

deploying the downhole tool at a first position in the wellbore for service;

treating the wellbore at the first position; and monitoring an at least one wellbore indication provided by the wellbore sensors at the first position, wherein deploying the downhole tool comprises:

sealing a lower boundary of a zone of interest with the first sealable member;

decoupling the first sealable member from the conveyance;

raising the downhole tool in the wellbore; and sealing an upper boundary of the zone of interest with the second sealable member, wherein one or more of the sensors hang down or float up from the first sealable member, the second sealable member, or both.

53. A method of monitoring a wellbore service treatment, comprising:

conveying into a wellbore with a conveyance:

a downhole tool operable to perform the wellbore service treatment, the downhole tool comprising a sealable member separable from the conveyance; and a plurality of sensors operable to provide one or more wellbore indications attached to the sealable member via one or more tethers both with the conveyance connected to and separated from the sealable member;

deploying the downhole tool at a first position in the wellbore for service;

treating the wellbore at the first position; and monitoring an at least one wellbore indication provided by the wellbore sensors at the first position, wherein deploying the downhole tool comprises:

sealing a lower boundary of a zone of interest with the sealable member;

decoupling the sealable member from the conveyance; and raising the downhole tool in the wellbore, wherein one or more of the sensors hang down or float up from the sealable member.

54. A method of monitoring a wellbore service treatment, comprising:

conveying into a wellbore with a conveyance:

a downhole tool operable to perform the wellbore service treatment, the downhole tool comprising a sealable member separable from the conveyance; and a plurality of sensors operable to provide one or more wellbore indications attached to the sealable member via one or more tethers both with the conveyance connected to and separated from the sealable member;

deploying the downhole tool at a first position in the wellbore for service;

treating the wellbore at the first position; and monitoring an at least one wellbore indication provided by the wellbore sensors at the first position, wherein the treating the wellbore at the first position comprises:

pumping a fracturing fluid into a formation penetrated by the wellbore;

stopping the pumping to provide a quiet period;

monitoring the sensors during the quiet period;

determining if more pumping of the fracturing fluid into the formation is needed; and optionally resuming pumping of the fracturing fluid.

* * * * *